US008701928B2

(12) United States Patent
Samson

(10) Patent No.: US 8,701,928 B2
(45) Date of Patent: Apr. 22, 2014

(54) SPOUT FOR A SPILL-PROOF BEVERAGE CONTAINER

(76) Inventor: Ilan Zadik Samson, La Jolla, CA (US)

( * ) Notice: Subject to any disclaimer, the term of this patent is extended or adjusted under 35 U.S.C. 154(b) by 0 days.

(21) Appl. No.: 13/496,455

(22) PCT Filed: Sep. 17, 2010

(86) PCT No.: PCT/IB2010/054209

§ 371 (c)(1),
(2), (4) Date: Mar. 15, 2012

(87) PCT Pub. No.: WO2011/033477

PCT Pub. Date: Mar. 24, 2011

(65) Prior Publication Data

US 2012/0168450 A1 Jul. 5, 2012

(30) Foreign Application Priority Data

Sep. 17, 2009 (GB) ..... 0916318.9
Sep. 24, 2009 (GB) ..... 0916793.3

(51) Int. Cl.
*B65D 47/06* (2006.01)
*B65D 25/40* (2006.01)
*A47G 19/22* (2006.01)

(52) U.S. Cl.
USPC ..... 220/703; 220/714; 220/717; 220/203.19; 215/11.4; 215/11.5; 222/532; 222/529; 222/490; 222/494; 137/843; 137/845; 137/846; 239/24; 239/33

(58) Field of Classification Search
CPC ..... B65D 47/20; B65D 25/40; B65D 47/06; A47G 19/22
USPC ..... 215/11.4, 11.5; 137/844, 845, 846; 222/532, 529, 490, 494; 220/714, 717, 220/703, 203.19; 239/24, 33
See application file for complete search history.

(56) References Cited

U.S. PATENT DOCUMENTS 274,447 A * 3/1883 Kennish ..... 251/143
1,647,215 A * 11/1927 Elsas ..... 222/490

(Continued)

FOREIGN PATENT DOCUMENTS

EP 0326743 A 8/1989
JP 2002360669 A 12/2002

(Continued)

OTHER PUBLICATIONS

European Patent Office, PCT International Search Report, Dec. 28, 2010.

(Continued)

*Primary Examiner* — Mickey Yu
*Assistant Examiner* — Gideon Weinerth
(74) *Attorney, Agent, or Firm* — The Mason Group Patent Specialists LLC; Valerie M. Davis

(57) ABSTRACT

A spout for a spill-proof beverage container has a side wall defining an outer surface and an inner surface defining a discharge passage. A valve in the discharge passage includes two flanks formed integrally with the side wall and projecting from opposite sides of the inner surface of the spout. The front end faces of the flanks mate with one another along a slit that extends generally parallel to the longer axis of the spout. At least the front portions of the flanks are inclined away from the mouth of the spout such that pressure within the container acts to urge the flanks against one another so as to maintain the slit closed. Deformation of the side wall when the spout is held between the lips of a drinker acts to open the slit and create an opening between the flanks to allow the beverage to be discharged.

7 Claims, 4 Drawing Sheets

(56) References Cited

U.S. PATENT DOCUMENTS

| | | | | | |
|---|---|---|---|---|---|
| 2,219,604 | A | * | 10/1940 | Trotter | 222/207 |
| 2,611,515 | A | * | 9/1952 | Smith | 222/213 |
| 2,644,663 | A | * | 7/1953 | Klingler | 137/846 |
| 2,730,274 | A | * | 1/1956 | Brown | 222/490 |
| 2,802,608 | A | | 8/1957 | Gassaway | |
| 2,816,548 | A | * | 12/1957 | Tupper | 215/11.1 |
| 3,179,299 | A | * | 4/1965 | Allegraud et al. | 222/207 |
| 3,342,318 | A | * | 9/1967 | Ruekberg et al. | 206/540 |
| 3,773,233 | A | * | 11/1973 | Souza | 222/490 |
| 3,825,157 | A | * | 7/1974 | Herzig | 222/494 |
| 4,341,239 | A | * | 7/1982 | Atkinson | 137/493 |
| 4,434,810 | A | * | 3/1984 | Atkinson | 137/493 |
| 4,946,062 | A | * | 8/1990 | Coy | 220/714 |
| 4,991,745 | A | * | 2/1991 | Brown | 222/212 |
| 5,035,340 | A | | 7/1991 | Timmons | |
| 5,052,594 | A | * | 10/1991 | Sorby | 222/490 |
| 5,072,842 | A | * | 12/1991 | White | 215/11.4 |
| 5,085,349 | A | * | 2/1992 | Fawcett | 220/703 |
| 5,186,347 | A | * | 2/1993 | Freeman et al. | 220/254.1 |
| 5,301,707 | A | * | 4/1994 | Hofsteenge | 137/12 |
| 5,330,437 | A | * | 7/1994 | Durman | 604/167.04 |
| 5,598,809 | A | * | 2/1997 | McInnes | 119/71 |
| 5,638,769 | A | * | 6/1997 | McIntyre et al. | 119/71 |
| 5,791,510 | A | * | 8/1998 | Paczonay | 220/714 |
| 6,032,831 | A | * | 3/2000 | Gardner et al. | 222/175 |
| 6,070,767 | A | * | 6/2000 | Gardner et al. | 222/175 |
| 6,135,311 | A | * | 10/2000 | Panec et al. | 220/705 |
| 6,343,704 | B1 | * | 2/2002 | Prentiss | 215/11.1 |
| 6,450,375 | B1 | * | 9/2002 | Hins et al. | 222/491 |
| 6,557,721 | B2 | * | 5/2003 | Yang | 220/713 |
| 6,585,005 | B1 | * | 7/2003 | Raftis et al. | 137/850 |
| 6,702,255 | B2 | * | 3/2004 | Dehdashtian | 251/149.3 |
| 6,874,760 | B2 | * | 4/2005 | Steckel | 251/342 |
| 7,147,121 | B2 | * | 12/2006 | Boucher et al. | 220/203.11 |
| 7,267,245 | B2 | * | 9/2007 | Yang | 220/703 |
| 7,445,028 | B1 | * | 11/2008 | Aanonsen et al. | 137/846 |
| 8,276,616 | B2 | * | 10/2012 | Wright et al. | 137/850 |
| 8,322,378 | B2 | * | 12/2012 | Allman et al. | 137/849 |
| 8,444,416 | B2 | * | 5/2013 | Chenvainu et al. | 433/80 |
| 2001/0054448 | A1 | * | 12/2001 | McFarland | 137/849 |
| 2002/0158075 | A1 | | 10/2002 | Caldicott et al. | |
| 2005/0067419 | A1 | * | 3/2005 | Gordon | 220/717 |
| 2005/0145636 | A1 | | 7/2005 | Albright et al. | |
| 2005/0184075 | A1 | * | 8/2005 | Belcastro | 220/714 |
| 2005/0242204 | A1 | * | 11/2005 | Ness et al. | 239/24 |
| 2006/0201902 | A1 | | 9/2006 | Brown et al. | |
| 2007/0138121 | A1 | * | 6/2007 | Stribling et al. | 215/11.4 |

FOREIGN PATENT DOCUMENTS

| | | | |
|---|---|---|---|
| JP | 2004121606 | A | 4/2004 |
| WO | 03101261 | A | 12/2003 |

OTHER PUBLICATIONS

Intellectual Property Office, UK Office Action, Jan. 13, 2010.
JPO Office Action, Jul. 23, 2013.

* cited by examiner

SPOUT FOR A SPILL-PROOF BEVERAGE CONTAINER

FIELD OF THE INVENTION

The present invention relates to a spout for a spill-proof beverage container and to a cap containing such a spout when fitted releasable or permanently to a beverage container.

BACKGROUND OF THE INVENTION

The need for spill-proof cups, as used by infants and the infirm, is well known. These are cups with a liquid-tight, preferably also air-tight, cap and are designed not to leak when the cup is held in a tilted or overturned position by a child, or when the cup falls on its side or even turns over. Preferably, the cup should also resist spillage when shaken or swung as happens when children carry it around carelessly. Additionally, it would be desirable if the cup, when inverted or partially so, is also capable of resisting internal pressures as generated when a partially filled cup warms up, for instance in a hot car, or generally some time after having been filled with liquid colder than the ambient air. Ideally, the cup should remain spill proof even with carbonated drinks and with hot warn/hot liquids where internal pressure is created when the cup is inverted, whereupon the warm liquid heats the ullage space, which tends to expand while the outlet is already covered. Finally, a cup should be economical to produce, be easily cleanable and resistant to damage from biting.

There are various known designs that go some way towards meeting the above desiderata. A first known design requires some deliberate action to be taken to seal and/or open the cups. Such cups suffer from the obvious disadvantage that an infant cannot be relied on to operate the closure.

Other known designs include a pressure operated valve that is intended to open automatically in response to a reduced pressure in the spout, and to reseal when the suction is removed. Most such valves suffer from the general problem that they cannot distinguish between high pressure within the container and low pressure in the spout. Therefore these valves are either not efficient in blocking leaks, or else they offer an undesirable level of resistance to suction.

A further problem with cups having pressure operated valves is that they cannot safely be used with carbonated or hot beverages. In the latter case, when the cup is inverted the liquid heats the air in the ullage space and increases the pressure within the container because the outlet is already covered by the liquid that is then driven out.

A spill-proof that avoids the above disadvantages has been disclosed in WO2008/125877 which uses a valve known as a self-sealing demand valve. The "self-sealing" refers to the fact that the pressure inside the container acts to close the valve rather than to open it. An important advantage of such a valve is that it can be designed to allow the valve to be opened by a very low suction level. However, the demand valve is made up of several components that need to be fitted to one another and which have to be dismantled for cleaning.

Caps for non-spill cups made from a single resilient moulding exist but they require a hefty biting action on the spout. Apart from the fact that biting down hard on a spout or nipple does not come naturally to an infant (thankfully for breast feeding mothers), it can damage the spout and reduce the life of the cup. Despite this major problem, cups with a one-piece cap still fail to achieve some of the desirable features mentioned above. In particular, they leak if shaken, and when filled with a hot or carbonated liquid.

OBJECT OF THE INVENTION

The present invention seeks to provide a spout for a spill-proof cup which meets the desiderata mentioned without having separable components in its valve.

SUMMARY OF THE INVENTION

According to the present invention, there is provided a spout for a spill-proof beverage container, the spout having a side wall made of a flexible material defining an outer surface to be contacted by the lips of a drinker and an inner surface defining a discharge passage leading to a mouth of the spout to permit a beverage to be sucked from the container by the drinker, the side wall having a cross section with a longer axis and a shorter axis and being held when in use in the mouth of the drinker with the longer axis parallel to the lips of the drinker, wherein a valve is provided in the discharge passage to prevent undesired spillage of the beverage when no person is drinking from the cup, the valve comprising two flanks formed integrally with the side wall of the spout and projecting from opposite sides of the inner surface of the spout, the front end faces of the flanks remote from the side walls mating with one another along a slit that extends generally parallel to the longer axis so that the two flanks form a continuous surface obstructing the discharge passage when the slit is closed, and wherein at least the front portions of the flanks are inclined away from the mouth of the spout such that pressure within the container acts to urge the flanks against one another so as to maintain the slit closed and such that deformation of the side wall of the spout when the spout is held between the lips of a drinker acts to open the slit and create an opening between the flanks to allow the beverage to be discharged.

In the present specification, where terms such as "upper" and "lower" are be used to describe the cup or its components, they will be assumed to refer to a cup that is resting on a horizontal surface with its cap and spout uppermost.

In a vertical cross section taken through a spout of the invention, the flanks of the valve define a downwardly pointing "V" with a slit at the lower end of the "V". If the cup is inverted, the fluid pressure acting on the sides of two flanks acts to close the slit and the greater the pressure, the more force is applied to keep the slit and the valve closed. If the ullage space is pressurised for any reason, such as the air in it being heated or by escape of gas from a carbonated drink, it will serve only to close the valve more firmly.

Examples of what is believed to be the closed prior art to the present invention are to be found in WO03/101261 and US 2006/0201902. These known spouts rely on one of more short slits in a generally horizontal surface that lies between vertical spout walls, the slits being perpendicular to the walls. The user needs to bite on the spout to apply a force in line with the length of the slits to force the walls towards each other thus forcing the sides of the slits apart. The direction of the applied force and the way that the slits open is well shown in FIGS. 2*d* and 2*e* of WO03/10261. The amount of parting is necessarily small and even this requires a considerable effort to compress the horizontal surface that lies between the walls of the spout.

A problem with such a configuration is that the resultant distortion in the horizontal surface is such that the sections between the slits stretch considerably. Consequently, the horizontal surface warps and tears easily, and caps incorporating such spouts have a limited lifetime.

By contrast, the configuration of the present invention is such that, even if bitten on, the material of the spout is mainly compressed, not distorted, making it less susceptible to damage.

The important feature that distinguishes the invention from the prior art is the direction in which the drinker must squeeze the spout to cause the slit to open. Whereas in the prior art the end of a slit are moved towards one another thereby forcing the sides of the slit to arc apart, in the present invention a force is applied at right angles to the length of the slit. The force alters the mutual inclination of the flanks defining the slit and thereby creates an opening between them.

Though the spout with a nearly circular cross section will function, it is preferred for it to have a cross section with a longer axis at least 20% and more preferably 50% longer than its shorter axis. This adapts the spout to the shape of the mouth and makes it easier for the lips of the drinker to seal around the spout. In a spout shaped in this manner, by arranging the slit at which the two flanks meet to extend generally parallel to the longer axis, one can also ensure that the drinker instinctively squeezes the spout in the correct direction to cause that the valve opens.

The spout may be generally elliptical (curved all round) or it may be shaped as an eye, that is to say shaped as two outwardly convex arcs meeting at two cusps.

The slit should preferably not extend as far as the side wall of the spout and reinforcement stops may be provided on the flanks at the ends of the slit to prevent the split from spreading as this may ultimately weaken the side wall.

The flanks forming the anti-spill valve are preferably spaced from the mouth of the spout such that the discharge passage includes a section between the valve and the mouth of the spout.

Several different forces act on the valve when the drinker sucks on the spout. First, the reduced pressure in the discharge passage above the valve will tend to raise the flanks, forcing them against one another attempting to close the valve. This however is counteracted by two other forces.

First, the reduced pressure in the section of the discharge passage above the valve will deform the side wall, drawing its opposite sides closer to one another, and bending them towards each other. The bending of the side wall will deflect the flanks of the valve downwards in a direction to open the valve. Second, the deformation of the side wall is further assisted by the natural instinct of the drinker to squeeze with the lips on the outer surface of the spout while sucking and even more so while swallowing. It is the resultant deformation of the flanks of the valve that are connected to the walls of the spout that causes the flanks to separate, to allow the applied suction to draw the beverage from the interior of the cup.

It is preferred to provide on the upper surfaces of the front of the two flanks projections that contact one another when the rear of the two flanks, i.e. their sides connected to the side wall of the spout, are urged towards one another. The projections act as fulcrums which cause the flanks to bend downwards when urged against each other. This causes the lower edges of the mating front faces of the flanks to separate and open the slit. The regions of the flanks without projections define then the upper end of channels through which the beverage can flow.

It is possible for the lower surfaces of the two flanks to be flat planes so that they meet along a straight line. It is preferred however to shape the mating surfaces of the two flanks to include a straight portion and a hollow beak that projects below the straight portion. Such a beak is created when downwardly projecting hollow troughs or valleys are formed in the lower surfaces of the flanks. The downwardly projecting beak can be a hollow dome or pyramid which is sealed when the spout is in the relaxed state, but its two halves separate like the beak of a bird when the walls of the spout are urged together. This pushes the upper corners of the beak (the two points at which their 'jaws' meet and which act as the above projections) against each other so as to cause the flanks to bend downwards.

BRIEF DESCRIPTION OF THE DRAWINGS

The invention will now be described further, by way of example, with reference to the accompanying drawings, in which.

DESCRIPTION OF THE PREFERRED EMBODIMENT(S)

Figure 1:
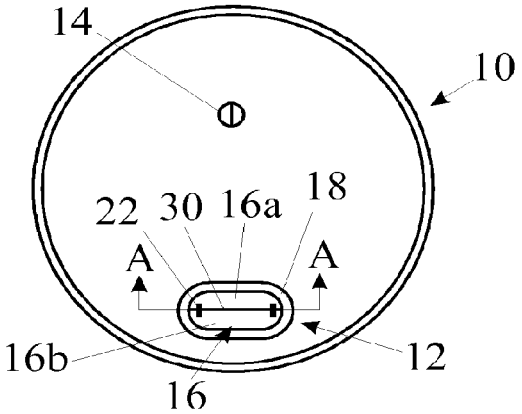
FIG. 1 is a plan view of a cap for a spill-proof cup in accordance with a first embodiment of the invention.

The cap 10 for a spill-proof container shown in FIG. 1 is moulded in one piece from an elastomeric material such as latex. The cap 10 has a spout 12 and a one-way pressure valve 14 to vent the ullage space of the container. The vent maintains the ullage space in the container at atmospheric pressure as beverage is sucked out of the container through the spout 12. As is common, the vent valve 14 is constructed as a sphincter valve which comprises an inwardly facing hemispherical dome that is slit along a great circle. The valve is operated automatically by the pressures on its opposite sides. When the pressure within the container is below atmospheric, the two halves of the hemisphere splay apart to allow air into the ullage space. However, when liquid tries the pressure on the two halves it forces the two halves together to seal the slit and prevent any liquid from escaping. Other forms of venting valves could be used, for instance duckbill valves.

The spout 12 has a non-circular cross section with longer and a shorter axis. This makes it more comfortable to use as it conforms to the shape of the lips and makes it easier for the drinker to seal the lips around the spout when swallowing. The spout 12 contains a anti-spill valve 16 which is designed to allow a person to drink from the container but prevents spillage under all other conditions.

Figure 2:
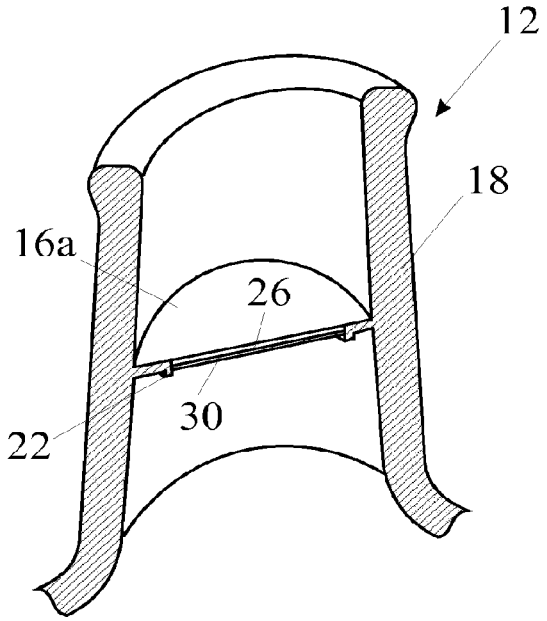
FIG. 2 is a sectional perspective view showing the spout of FIG. 1 cut along the line A-A.

The valve 16 comprises two flanks 16*a* and 16*b* that protrude from the inner surface of the side wall 18 of the spout. Only one of these flanks 16*a* is shown in the cut away view of FIG. 2. The valve is generally symmetrical and its other half is a mirror image of FIG. 2. As is presented schematically in FIGS. 3 and 4, the two flanks 16*a* and 16*b* are inclined downwards to form a "V" pointing into the interior of the container. Along their sides remote from the side wall of the spout, the two flanks meet at a slit 30 that extends parallel to the longer axis of the cross section of the spout 12.

In the manufacture of the cap 10, the two flanks 16*a* and 16*b* are moulded as one continuous web that extends across the passage defined by the inner wall of the spout 12. The slit 30 is cut subsequently using a sharp blade. The slit 30 is not as long as the longer axis of the spout and stops short of the inner wall. Small reinforcement stops 22 at the ends of the slit 30 slit 18 prevent it from spreading.

Figure 3:
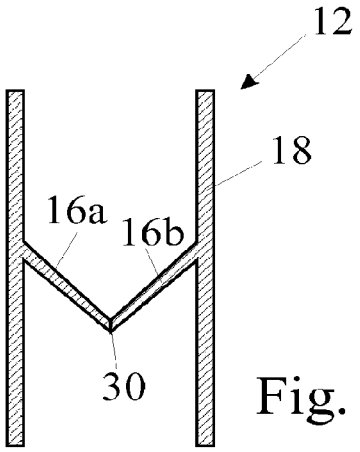
FIG. 3 is a schematic representation of the spout of FIGS. 1 and 2 in its closed position.
Figure 4:
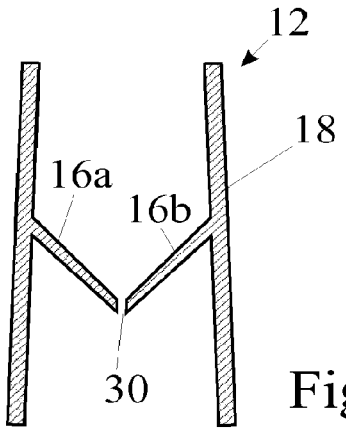
FIG. 4 is a schematic representation of the spout of FIGS. 1 and 2 in its open position.

In the closed position of the valve shown in FIG. 3, the flanks 16*a* and 16*b* are in contact and seal the slit 30. Because of the inclination of the flanks 16*a* and 16*b*, high pressure within the container forces them more firmly together and improves the seal. This construction is sufficient to prevent any liquid from being spilled through the spout even if the container is inverted and shaken. The closure of the valve does not result from a constricting effect of the stiffness and the smallness of the passage but due to the structure of the valve's and the geometry of its constituents.

It should be noted that using a sphincter valve as an anti-spill valve, as is already in common use, offers only limited 'self-locking' because under sufficient pressure the two halves of the hemisphere can invert and open outwards. In the present invention, especially if the top surfaces of the flanks form an angle of 90° or less with one another, a true self-locking is achieved which should never break through. This is the reason that the valve 16 of the present invention is capable of preventing leakage and spillage even if the container is filled with a hot liquid or a carbonated beverage.

To drink from the container, the spout is placed between the lips with its longer axis parallel to the lips. The drinker then sucks on the mouth of the spout while applying light pressure with the lips to seal around the spout. Such action is entirely instinctive to both infants and adults. The effect of the lip pressure on the side wall of the spout is shown schematically in FIG. 4. The lips of the drinker tend to force the side walls of the spout towards one another at the mouth end of the spout while its lower end, which is connected to remainder of the cap, remains essentially stationary. Consequently the opposite sides of the spout tilt and as the flanks 16*a* and 16*b* are relatively thick, they too are deflected in the manner illustrated in FIG. 4 to open the slit 18 and thereby free a passage to allow the beverage to be sucked out.

When the lips are released, the spout automatically returns to its natural state on account of its resilience.

Thus, the only time that liquid can be discharged from the container is while the spout is being squeezed between the lips of the person drinking from the cup.

The flanks 16*a* and 16*b* need to be of a substantial thickness if they are to move with the side wall of the spout. Slitting a thick layer of latex or a similar elastomeric material presents difficulty in practice and for this reason, a thin groove is moulded into the flanks 16*a* and 16*b* to leave only a reduced thickness at the bottom of the groove to be slit after the moulding operation. This groove can be seen in FIG. 2 where it is designated 26.

The embodiment of FIG. 1 will function correctly as long as the lip pressure is applied at some distance from the flanks 16*a* and 16*b*. If the spout is squeezed level with the flanks 16*a* and 16*b* they will be forced together instead of being pulled apart by the tilting of the side wall of the spout. This problem can be overcome by moving the valve 16 further down the spout 12 to a region that cannot readily be reached by the lips but there it would be less susceptible to the desired deformation. Therefore the embodiment of FIGS. 5 to 8 provides a superior solution to this problem.

To avoid repetition, in all the embodiments, like components have been allocated reference numerals with the same last two digits, the first digit being indicative of the embodiment. More particularly, a side wall is labeled as 18 in FIGS. 1-4, as 118 in FIGS. 5-8, and as 218 in FIGS. 9-10. A cap is labeled as 10 in FIG. 1, as 110 in FIG. 5, and as 210 in FIG. 9. A one-way pressure valve is labeled as 14 in FIG. 1, as 114 in FIG. 5, and as 214 in FIG. 9. Reinforcement stops are labeled as 22 in FIGS. 1-2 and as 322 in FIG. 11. A thin groove is labeled as 26 in FIG. 2 and as 326 in FIG. 11.

Figure 5:
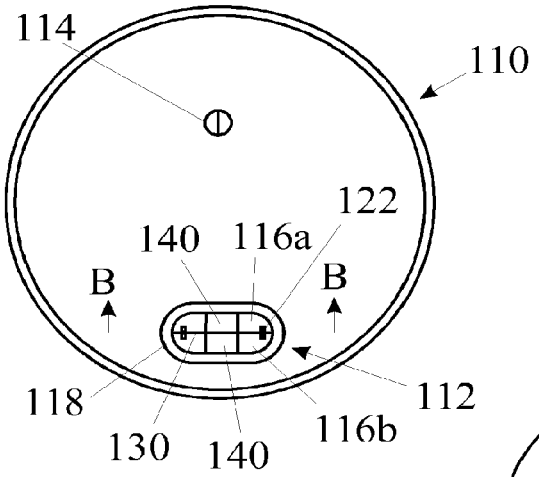
FIG. 5 is a plan view of a cap for a spill-proof cup in accordance with a second embodiment of the invention.
Figure 6:
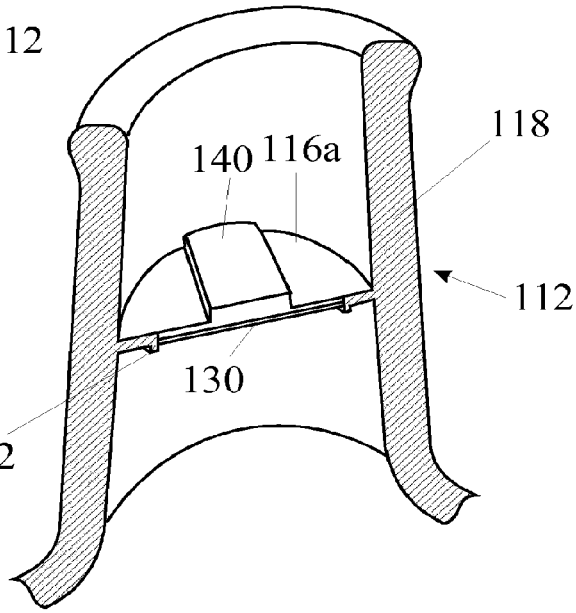
FIG. 6 is a sectional perspective view showing the spout of FIG. 5 of the second embodiment of the invention cut along the line B-B.

The difference between the embodiment of FIG. 5 and that of FIG. 1 is that the modified flanks 116*a* and 116*b* are provided on their upper surface with projections 140. As illustrated, each of the flanks 116*a*, 116*b* has a single central projection 140 but it is alternatively possible to provide more than one projection on each flank. The projections 140 must be arranged symmetrically on the two flanks and they must not extend across the entire width of the spout.

Figure 7:
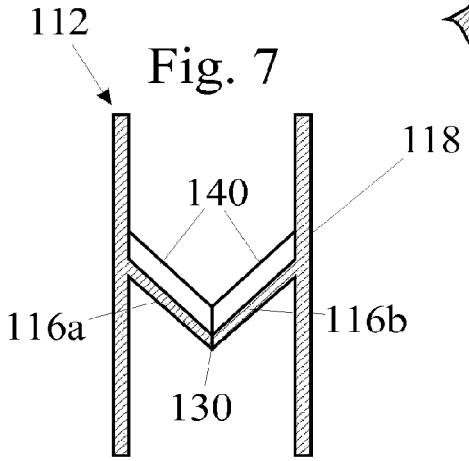
FIG. 7 is a schematic representation of the spout of FIGS. 5 and 6 in its closed position.
Figure 8:
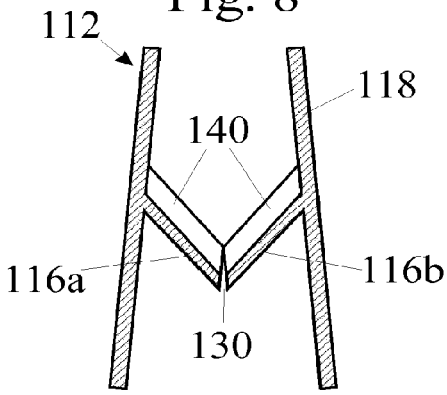
FIG. 8 is a schematic representation of the spout of FIGS. 5 and 6 in its open position.

The action of these projections 140 will now be explained by reference to FIGS. 7 and 8. In the relaxed state of the spout 112, the two flanks 116*a* and 116*b* once again abut each other to close the slit 130. However, as the sides of the spout 112 are urged together the upper edges of the projections 140 abut one another and act as fulcrums. Further squeezing of the sides of the spout causes the two flanks 116*a* and 116*b* to bend about these fulcrums as shown in FIG. 8 splaying the lower edges of the flanks apart and opening the slit 130. If the projections 140 were to extend across the entire width of the spout, the opening of the slit 130 would serve no useful purpose because there would be a seal between the projections 140 at the points acting as fulcrums. However, when they are not as wide as the spout 112, the remaining regions of the flanks 116*a* and 116*b* act as channels through which liquid can be sucked out of the container.

Thus in the construction illustrated in FIG. 5, squeezing the spout creates two triangular openings starting at the side edges of the projections 140 and terminating at a point at the reinforcement stops 122.

Figure 9:
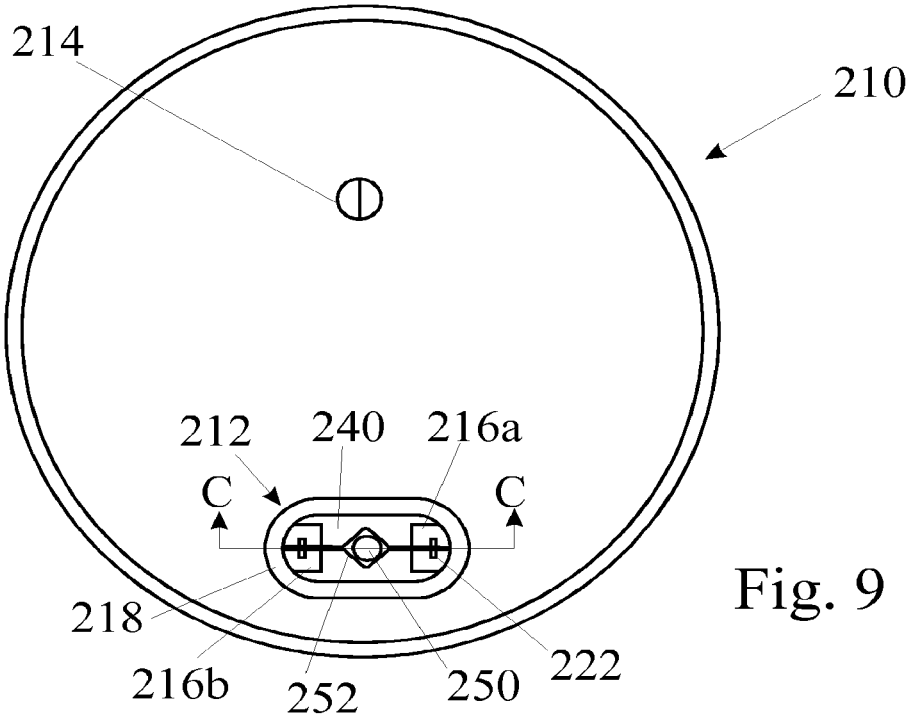
FIG. 9 is a plan view of a cap for a spill-proof cup in accordance with a third embodiment of the invention.
Figure 10:
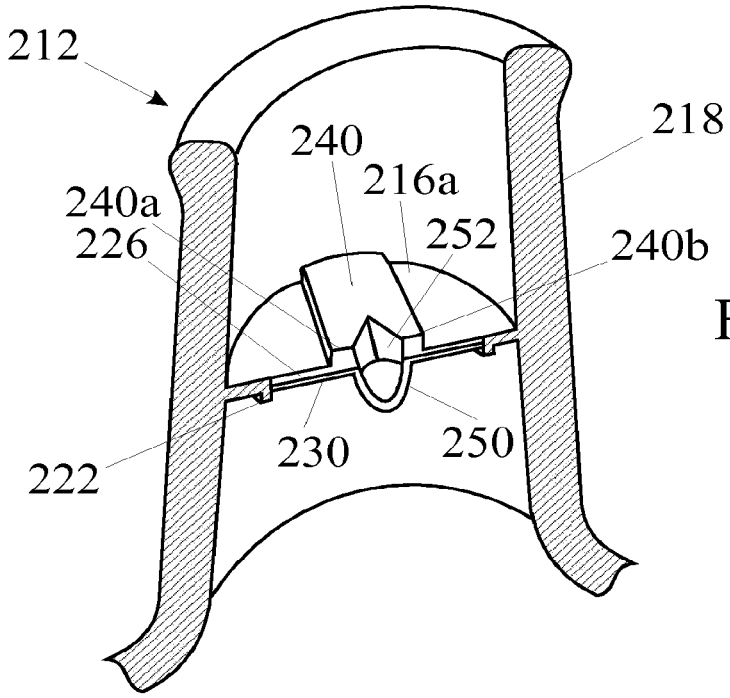
FIG. 10 is a sectional perspective view showing the spout of the third embodiment cut along the line C-C in FIG. 9.

The disadvantage of the embodiments of FIGS. 5 to 8 is that the cross section of these two triangular openings is relatively small and the embodiment of FIGS. 9 and 10 shows an improvement that increases the area of the slit plane to reduce the degree of suction that is needed when drinking.

The most preferred embodiment of the invention shown in FIGS. 9 and 10 differs from that of FIGS. 5 to 8 by the addition of a hollow beak 250 on the underside of the flanks 216*a* and 216*b* that communicates with a pyramidal valley 252 formed in the projection 240. The projections 240 now have two shoulders 240*a* and 240*b* that straddle the pyramidal valley 252 and it is these that act as fulcrums when the two sides of the spout 212 are squeezed together. The increased distance from the lowest point in the beak 250 to these fulcrums results in the beak 250 being opened wider than the slit 230 and the perimeter of the beak 250 is significantly longer than its width so that the area through which liquid can pass when the beak 250 is opened is much greater than can be achieve with a straight slit.

When the spout of FIG. 9 is squeezed, in addition to the two triangular openings present in the embodiment of FIG. 5, there will be a larger central opening through the beak that allows liquid to flow freely.

The embodiment of FIGS. 9 and 10 also offers the advantage that applying pressure along the longer axis of the spout only causes the flanks to buckle and does not force them apart in the shape of an eye. This serves to prevent serious spillage even if the spout is misused.

A further embodiment could be similar to that shown in FIG. 10 save that the projection 240 may extend over the whole of the upper side of the flanks and, may optionally include more than one beak 250.

Figure 11:
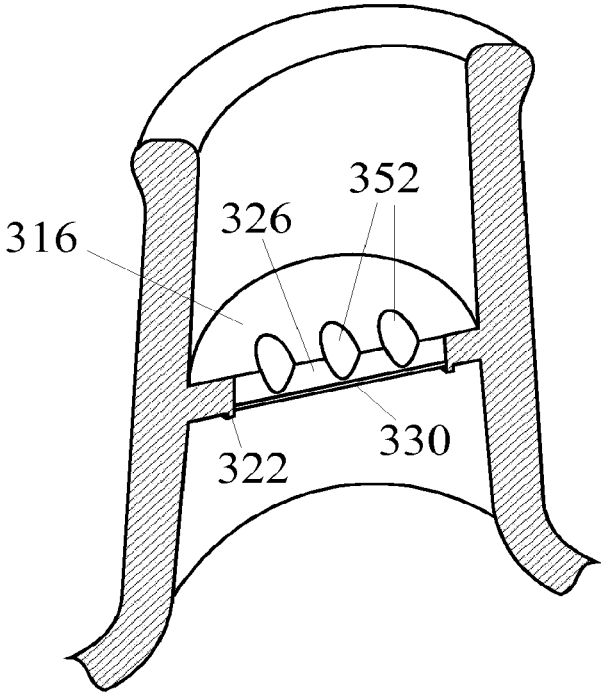
FIG. 11 is a sectional perspective view showing the spout of a fourth embodiment of the invention.

A still further embodiment of the invention is shown in FIG. 11. Here the flanks 316 are made somewhat thicker at their front sides and depressions 352 are formed in the top edges of the flanks. Once again the shoulders between the depressions push against one another and when the sides of the spout are urged towards each other the lower edges of the flanks splay apart to open the slit 330 and allow liquid to pass through the channels formed by the depressions 352.

The invention claimed is:

1. A spout for a spill-proof liquid container, the spout having a side wall made of a flexible material defining an outer surface to be contacted by an external object and an inner surface defining a discharge passage leading to a mouth of the spout to permit discharge of a liquid from the container, the side wall having a cross section with a longer axis and a shorter axis, wherein a valve is provided in the discharge passage, the valve comprising two flanks formed integrally with the side wall of the spout and projecting from opposite sides of the inner surface of the spout, the flanks having a front with front end faces that are remote from the side walls and mate with one another along a slit that extends generally parallel to the longer axis so that the two flanks form a continuous surface obstructing the discharge passage when the slit is closed, and wherein at least the front end faces of the flanks are inclined away from the mouth of the spout such that pressure within the container acts to urge the flanks against one another so as to maintain the slit closed and such that deformation of the side wall of the spout when pressure is applied on the outer surface of the spout acts to open the slit and create an opening between the flanks to allow the liquid to be discharged, wherein projections are provided on upper surfaces of the front of the two flanks, which projections contact one another when a rear of the two flanks are urged towards one another, the projections then acting as fulcrums to cause lower edges of the front end faces of the flanks to separate and open the slit and such that at least along part of the fronts of the flanks a continuous passage forms between a bottom and top of the valve.

2. A spout as claimed in claim 1, wherein the flanks of the valve are spaced from the mouth of the spout such that the discharge passage includes a section between the valve and the mouth of the spout.

3. A spout as claimed in claim 1, wherein lower surfaces of the two flanks meet one another along a straight line.

4. A spout as claimed in claim 1, wherein mating surfaces of the two flanks are shaped to include a straight portion and a hollow beak that projects below the straight portion.

5. A spout as claimed in claim 1, wherein upper edges only of mating surfaces of the two flanks are shaped to include at least one depression.

6. A spout as claimed in claim 1, wherein the side wall of the spout and the valve are formed as a one piece moulding of an elastomeric material.

7. A spout as claimed in claim 1, wherein the spout forms part of a cap fitted to a container, the cap further including a pressure relief valve to allow air to be admitted into the container while preventing discharge of the liquid from the container.

* * * * *